US009949318B2

(12) United States Patent
Whitcraft

(10) Patent No.: US 9,949,318 B2
(45) Date of Patent: Apr. 17, 2018

(54) PORTABLE HEATING ARRANGEMENT

(71) Applicant: Amante Radiant Supply, Inc., Pittsburgh, PA (US)

(72) Inventor: Josh Whitcraft, Pittsburgh, PA (US)

(73) Assignee: Amante Radiant Supply, Inc., Pittsburgh, PA (US)

( * ) Notice: Subject to any disclaimer, the term of this patent is extended or adjusted under 35 U.S.C. 154(b) by 885 days.

(21) Appl. No.: 14/050,779

(22) Filed: Oct. 10, 2013

(65) Prior Publication Data

US 2014/0097178 A1 Apr. 10, 2014

Related U.S. Application Data

(60) Provisional application No. 61/711,904, filed on Oct. 10, 2012.

(51) Int. Cl.

| | |
|---|---|
| ***H05B 3/34*** | (2006.01) |
| ***H05B 3/06*** | (2006.01) |
| ***E04D 13/10*** | (2006.01) |

(52) U.S. Cl.

CPC ..... *H05B 3/34* (2013.01); *E04D 13/103* (2013.01); *H05B 3/06* (2013.01); *H05B 2214/02* (2013.01); *Y10T 29/49826* (2015.01)

(58) Field of Classification Search

CPC ..... H05B 3/34; H05B 3/06; H05B 2214/02; E04D 13/103; Y10T 29/49826

USPC ..... 219/528, 541

See application file for complete search history.

(56) References Cited

U.S. PATENT DOCUMENTS 2,546,743 A * 3/1951 Harrison ..... E04D 1/26 219/201
2,566,921 A * 9/1951 Briscoe ..... H05B 3/78 219/523
2,640,138 A * 5/1953 Merritt ..... F02N 19/10 123/142.5 E
2,912,555 A * 11/1959 Jamison ..... F24D 13/022 219/213
3,010,007 A * 11/1961 Theodore ..... F24D 13/022 156/177
3,129,316 A * 4/1964 Glass ..... E04D 13/103 219/213
3,691,343 A * 9/1972 Norman ..... E04D 13/103 165/47
3,806,702 A * 4/1974 Spencer ..... F24D 13/024 200/61.04
3,808,403 A * 4/1974 Kanaya ..... B63C 11/28 219/212
4,270,040 A * 5/1981 McMullan ..... H05B 3/36 219/212

(Continued)

*Primary Examiner* — Eric Stapleton

(74) *Attorney, Agent, or Firm* — The Webb Law Firm

(57) ABSTRACT

A portable heating arrangement for providing heat to a surface, such as a roof and rain gutter is provided. The portable heating arrangement includes a base configured to rest upon the surface and at least one heating conduit directly or indirectly mounted to at least a portion of the base and configured to provide heat to the surface. The heating arrangement may further include at least one connector configured to directly or indirectly attach at least a portion of the base to the surface. The heating conduit may include a metal wire enclosed within a conductive core and polymer sheath. A method of forming a portable heating arrangement and a method for heating a surface are also provided herein.

10 Claims, 11 Drawing Sheets

(56) References Cited

U.S. PATENT DOCUMENTS 4,293,763 A * 10/1981 McMullan ..... H05B 3/36 219/212
4,358,668 A * 11/1982 McMullan ..... H05B 3/06 219/212
4,406,719 A * 9/1983 Mitsumoto ..... B29C 43/22 100/138
4,523,086 A * 6/1985 Eilentropp ..... H01B 7/0823 219/528
4,825,048 A * 4/1989 Altmann ..... A47C 7/748 219/202
5,111,025 A * 5/1992 Barma ..... A47C 7/748 219/217
5,175,414 A * 12/1992 Hara ..... C23D 13/00 219/528
5,780,820 A * 7/1998 Komyoji ..... H05B 3/145 219/217
5,786,563 A * 7/1998 Tiburzi ..... E04D 13/076 219/213
5,813,184 A * 9/1998 McKenna ..... H05B 3/00 52/518
5,961,869 A * 10/1999 Irgens ..... H05B 3/36 219/213
6,166,352 A * 12/2000 Turton ..... E04D 13/103 219/213
6,184,495 B1 * 2/2001 Jones ..... E04D 13/103 219/213
6,184,496 B1 * 2/2001 Pearce ..... E01C 11/265 219/202
6,215,102 B1 * 4/2001 Jones ..... E04D 13/103 219/213
6,297,475 B2 * 10/2001 Jones ..... E01C 11/265 219/213
6,433,319 B1 * 8/2002 Bullock ..... H01C 17/16 219/541
6,483,990 B1 * 11/2002 Bikhovsky ..... H05B 3/10 219/548
6,489,594 B2 * 12/2002 Jones ..... E04D 13/103 219/213
6,704,497 B2 * 3/2004 Bikhovsky ..... H05B 3/10 219/548
6,708,452 B1 * 3/2004 Tenute ..... E04D 13/0762 219/213
6,712,486 B1 * 3/2004 Popovich ..... A47C 7/725 361/719
6,847,018 B2 * 1/2005 Wong ..... H05B 3/34 219/505
6,875,954 B2 * 4/2005 DeBenedetto ..... E04D 13/103 219/212
6,891,136 B2 * 5/2005 Bikovsky ..... A61F 7/007 219/528
6,959,512 B2 * 11/2005 Cobb ..... E04D 13/0481 219/213
6,978,577 B2 * 12/2005 Jones ..... E04D 13/0762 248/48.1
7,071,446 B1 * 7/2006 Bench ..... E04D 13/103 219/211
7,212,718 B2 * 5/2007 Sato ..... G02B 6/2558 219/520
7,329,843 B2 * 2/2008 Bikhovsky ..... A61F 7/007 219/528
7,626,146 B2 * 12/2009 Steinhauser ..... F16L 53/008 219/528
7,919,733 B2 * 4/2011 Ellis ..... F16L 53/008 138/112
8,158,231 B2 * 4/2012 Hopkins ..... H05B 3/34 219/200
8,536,497 B2 * 9/2013 Kim ..... E21B 43/24 219/541
9,095,007 B2 * 7/2015 McGillycuddy ..... E04D 13/103
9,297,541 B1 * 3/2016 McGillycuddy ..... F24D 13/00
2002/0124476 A1 * 9/2002 Iannelli ..... E04D 13/076 52/11
2003/0016954 A1 * 1/2003 Bikhovsky ..... H05B 3/10 392/458
2003/0029860 A1 * 2/2003 Bullock ..... H01C 17/06 219/541
2003/0230565 A1 * 12/2003 Bikovsky ..... A61F 7/007 219/528
2004/0004066 A1 * 1/2004 Evans ..... E01C 11/265 219/213
2004/0195226 A1 * 10/2004 Stabile ..... E01C 11/265 219/213
2004/0244324 A1 * 12/2004 McKenna ..... E04D 13/103 52/533
2005/0210758 A1 * 9/2005 Iannelli ..... E04D 13/076 52/11
2006/0048456 A1 * 3/2006 Iannelli ..... E04D 13/0481 52/13
2006/0206177 A1 * 9/2006 Bikhovsky ..... A61F 7/007 607/96
2006/0289110 A1 * 12/2006 Schmitt ..... H05B 3/36 156/250
2007/0012845 A1 * 1/2007 Iannelli ..... E04D 13/076 248/312.1
2007/0119848 A1 * 5/2007 Ellis ..... F16L 53/008 219/541
2008/0029654 A1 * 2/2008 Iannelli ..... E04D 13/0725 248/48.2
2009/0031638 A1 * 2/2009 Iannelli ..... E04D 13/076 52/12
2010/0065543 A1 * 3/2010 Dubey ..... H05B 3/34 219/213
2010/0206410 A1 * 8/2010 Patten ..... C10G 1/02 137/615
2010/0218526 A1 * 9/2010 Ducharme ..... F25C 5/005 62/176.1
2011/0070004 A1 * 3/2011 Mizumo ..... H05B 3/0095 399/333
2011/0121703 A1 * 5/2011 Karlicek, Jr. ..... G02B 6/0085 313/46

* cited by examiner

PORTABLE HEATING ARRANGEMENT

CROSS REFERENCE TO RELATED APPLICATIONS

This application claims the benefit of U.S. Provisional Patent Application No. 61/711,904 entitled "Portable Heating Arrangement" filed Oct. 10, 2012, which is hereby incorporated by reference in its entirety.

BACKGROUND OF THE INVENTION

Field of the Invention

The present invention relates generally to devices and arrangements of devices for heating surfaces and, in particular, to a portable heating arrangement including a heating conduit extending across a surface, such as a roof, and/or through a trough or channel, such as a rain gutter, for the purpose of preventing the buildup of ice and snow.

Description of Related Art

Accumulation of ice and snow on roofs and in rain gutters presents a variety of problems for property owners. For example, accumulated ice and snow apply pressure against a roof and gutter which, over time, weakens the structure. Furthermore, accumulated ice and snow may thaw and freeze many times over the course of the winter permitting water to collect in cracks and to expand during freezing, further weakening the roof and gutter structure. Additionally, accumulated ice and snow may block gutters. As a result, during rainstorms the gutter overflows causing water damage to the building or property. Further still, accumulated ice and snow can cause rust, damaging metal portions of a roof or gutter and causing the structure to degrade prematurely.

In view of these problems, various heating systems are available to melt ice and snow from roofs and gutters to prevent accumulation of ice and snow. For example, electric radiant heating systems consisting of a conductive wire or cable permanently installed on a roof or inserted along a rain gutter, are well known. When a user becomes concerned that snow and ice is accumulating, the user turns on the system causing the cables to heat up, thereby melting the snow and ice.

There are two main types of electric radiant heating cables, constant wattage cables and self-regulating cables. When electricity is applied, constant wattage cables maintain a fixed wattage output and, consequently, produce only one level of heat. With systems including self-regulating cables, the wattage of the cables (and, correspondingly, the heat output) increases as the temperature drops. Self-regulating cables tend to be more durable than constant wattage cables, but are also more expensive.

Typically, these permanent systems are installed by a roofer and/or an electrician (hereinafter "the installer"). The installation process tends to be a time consuming and rather labor intensive process. Initially, the installer selects, measures, and lays out a pattern for the heating cables along the roof surface and through the gutter. The cables are often arranged in a "zig-zag" pattern extending longitudinally along the roof surface near the lower edge of the roof and into the gutter.

Once the correct path for the wire is laid out, the installer installs roof clips directly to the roof in accordance with the selected pattern. For example, the roof clips may be fastened below the shingle with a nail or screw. Roofing cement or adhesive may also be used to secure the clips to the roof. Alternatively, the clip may be installed on top of the shingle by driving the fastener through the shingle. Once the clips are in place, the installer weaves the cable through the clips to attach the cables to the roof. The clips and cable are permanently installed on the roof and are intended to remain in place for the entire useful life of the heating system. When the cables fail, the old cables must be removed and the entire installation process repeated. Most constant wattage cables have one or two year warranties. Self regulating cables have warranties of about five to ten years.

Known systems using permanently installed heating cables have numerous drawbacks. Most significantly, such permanent systems are expensive as a result of both the cost of the cables themselves, which can be several hundred dollars, and the labor intensive installation process. In addition, the useful life of the heating system is limited by the lifespan of the cable. Even more durable self-regulating cables are only under warranty for five to ten years; in comparison, a newly installed roof may last 30 years or longer.

Furthermore, while wear and tear caused by snow and ice accounts for some of the degradation of the installed systems, the greatest impact on the lifespan of the cables is from prolonged exposure to solar ultraviolet (UV) radiation, which breaks down the rubber or synthetic polymer casing surrounding the cable. Continual heating and cooling of the cable also causes the wires to swell and contract over time, which weakens the clips and roof shingles. Thus, exposure to the elements during the summer months, when UV levels and temperature are higher, contributes to the breakdown of the heating cables as much as exposure to ice and snow during winter. Still further, the permanent cable systems trap debris such as dead leaves and vegetation in the gutter, meaning that gutters must be cleaned more frequently. Blockage of gutters is especially problematic during spring and autumn, when dead leaves and vegetation are most likely to accumulate on roof surfaces. Finally, property owners dislike the appearance of wire heating systems and would prefer if such systems were not visible during times of the year when they are most likely to be outside and able to see the installed cables.

SUMMARY OF THE INVENTION

Accordingly, the present invention provides a heating arrangement for providing heat to a surface that overcomes some or all of the drawbacks and deficiencies identified above, in connection with conventional permanently-installed heating systems. Preferably, the present invention provides a heating arrangement that can be easily installed by a property owner without needing a roofer or an electrician to perform the work. Preferably, the present invention provides a heating arrangement that is easily removable from the roof and gutter and, once removed, is easily portable and storable. By making the system easily portable, the property owner can take down the heating cables during times of the year when the system is not in use (e.g., spring, summer, and autumn), thereby reducing the amount of UV radiation that the cables are exposed to during the year and reducing the times during the year when the unsightly system is in place. Preferably, the present invention provides a heating arrangement that can be installed in a relatively inexpensive manner and will continue to provide effective heat to the surface for many years.

Accordingly, and in one preferred and non-limiting embodiment, provided is a portable heating arrangement for providing heat to a surface including a base configured to rest upon the surface and at least one heating conduit directly or indirectly mounted to at least a portion of the base and configured to provide heat to the surface. The heating conduit may be a metal wire enclosed within a conductive core and polymer sheath. The heating conduit may further include a female plug located at an end of the heating conduit. In certain preferred and non-limiting configurations, at least a portion of the base may include a flexible sheet at least partially including at least one of the following: a wire material, a mesh material, a polymer mesh material, a weather resistant material, or any combination thereof.

In other preferred and non-limiting configurations, the heating conduit of the portable heating arrangement is arranged in a substantially zig-zag pattern having a plurality of upper and lower crest portions. The lower crest portions may extend below a lower edge of the base. In one preferred and non-limiting embodiment, the distance between the apex of the lower crest portion and the lower edge of the base is about ⅓ of the total amplitude of the zig-zag pattern. The heating conduit may further include a straight portion extending substantially parallel to the lower edge of the base and positioned below the lower crest portion of the heating conduit. A cable connector may be used for connecting the straight portion of the cable to the apexes of the lower crest portions of the heating conduit. In certain preferred and non-limiting configurations, the heating conduit forms an electric circuit which includes a power supply, the heating conduit, and a switch for turning the circuit on and off.

In certain further preferred and non-limiting configurations, the arrangement further includes at least one connector configured to directly or indirectly attach at least a portion of the base to the surface. The at least one connector may be in the form of clips configured to engage the surface by a frictional engagement that is configured to hold to a shingle without piercing the shingle. Alternatively, in some preferred and non-limiting configurations, such as when the surface is a metal roof, the connectors may include a plurality of magnets for connecting the arrangement to the metal roof. The arrangement may further include a plurality of extendable side connectors in the form of a tether attached, at one end, to a side edge of the base, and at an opposite end, to a connector, for connecting the side edge of the base to the surface. Further still, the arrangement may include a plurality of ties for connecting the heating conduit to the base.

In certain preferred and non-limiting configurations, the ties for connecting the heating conduit to the base comprise a releasable lock, such that the ties can be disconnected from the base, moved to a different location on the base, and reconnected to the base so that the pattern of the heating conduit can be modified. In certain preferred and non-limiting configurations, the arrangement further includes a track extending along an upper edge of the base, where the connectors may be slidably mounted along the track, so that the connectors can be moved along the upper edge of the base.

In certain configurations, the portable heating arrangement may further include at least one guide for directing one or more of the lower crest portions of the heating conduit in a downward orientation relative to the base, thereby positioning at least a portion of the lower crest portions in a trough, channel, or gutter, or any combination thereof. The guide may include a body including a first member and a second member joined at a center, an end of the first member located opposite the center, and an end of the second member located opposite the center; a first arm extending from the end of the first member at a first rotatable joint; a second arm extending from the end of the second member at a second rotatable joint; and, a plurality of protrusions extending from the body configured to hold a heating conduit against the body. The first and second rotatable joints rotate the body, thereby bending the heating conduit attached thereto toward the trough, channel, or gutter. Optionally, the center includes an adjustable pivot for modifying the angle between the first member and the second member of the body. The guide may be formed from a conductive material such as aluminum.

According to a further aspect of the invention, a method for forming a portable heating arrangement is provided. The method includes providing a base configured to rest upon the surface. A heating conduit is directly or indirectly mounted to the base in a substantially zig-zag pattern. The at least one heating conduit is configured to provide heat to the surface. The method may further include attaching at least one connector to the base, wherein the at least one connector is configured to attach the base and conduit mounted thereto to the surface.

According to a further aspect of the invention, a method for heating a surface is provided. The method includes placing a rolled portable heating arrangement on a surface to be heated. The portable heating arrangement includes a base configured to rest upon the surface and at least one heating conduit directly or indirectly mounted to the base. The portable heating arrangement is unrolled along the surface to be heated and the at least one heating conduit is activated to provide heat to the surface.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

Some of the advantages and features of the preferred embodiments of the invention have been summarized hereinabove. These embodiments, along with other potential embodiments of the device, will become apparent to those skilled in the art when referencing the following drawings in conjunction with the detailed descriptions as they relate to the figures.

DETAILED DESCRIPTION OF THE PREFERRED EMBODIMENTS

Figure 1A:
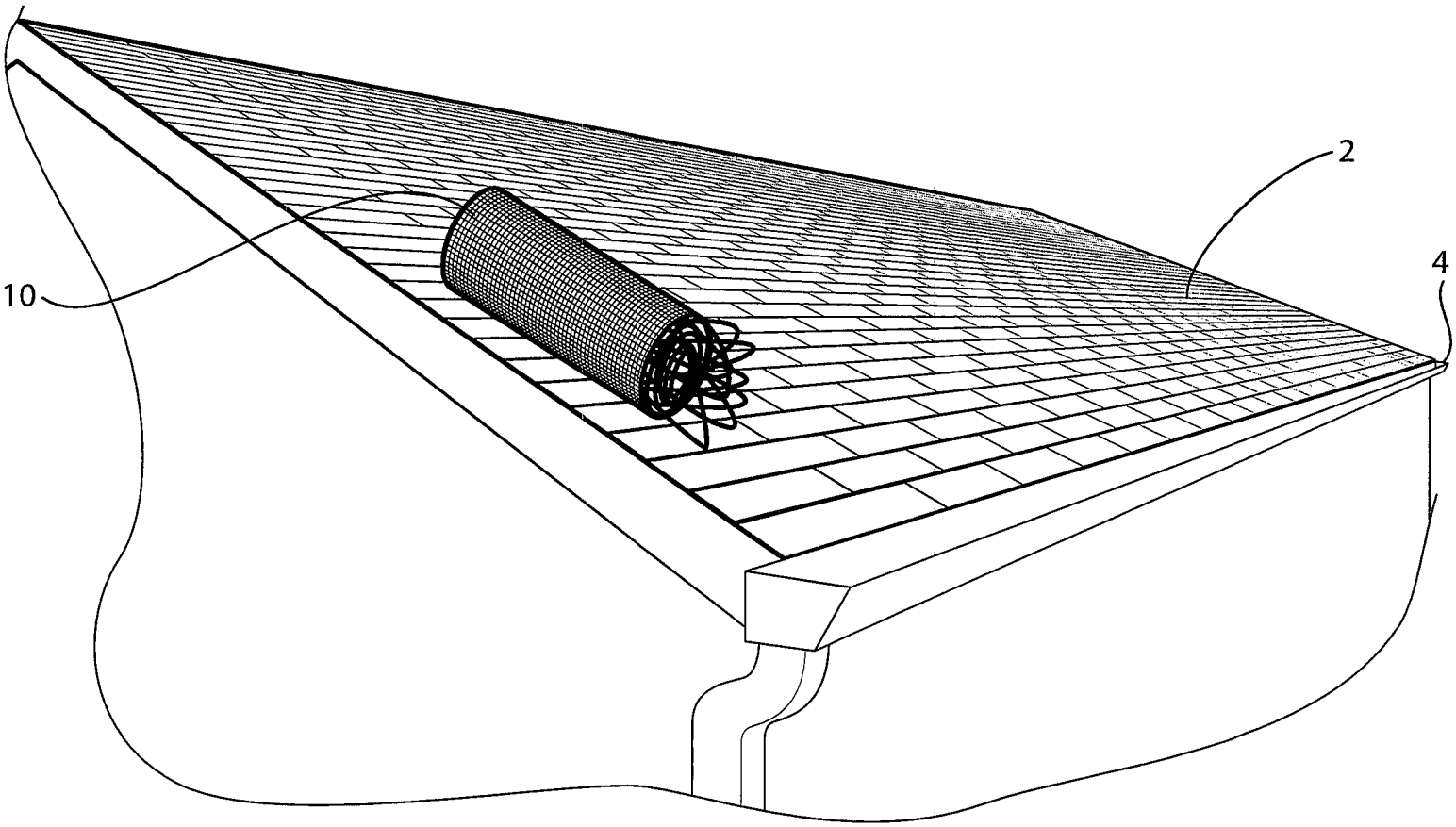
FIG. 1A is a perspective view of a portable heating arrangement for providing heat to a surface, in a rolled position, according to the principles of the present invention.

For purposes of the description hereinafter, the teens "upper", "lower", "right", "left", "vertical", "horizontal", "top", "bottom", "lateral", "longitudinal" and derivatives thereof shall relate to the invention as it is oriented in the drawing figures. Similarly, as used herein, the term "below" refers to the downward direction, as depicted in the drawing figures. However, it is to be understood that the invention may assume various alternative variations, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention is a portable heating arrangement 10 for providing heat to a surface 2, such as a synthetic shingle, wood, slate, or metal roof. The roof may be substantially flat or pitched. The arrangement 10 may also be used to heat a trough or channel extending from the roof, such as a rain gutter. The rain gutter may be formed from metal, such as aluminum, or a synthetic material such as vinyl. By providing heat to the surface 2 and trough or channel 4 attached thereto, build up of ice and snow, and problems associated therewith, are prevented. Various preferred and non-limiting embodiments of the arrangement 10 (or portions thereof) are illustrated in FIGS. 1A-11.

Figure 1B:
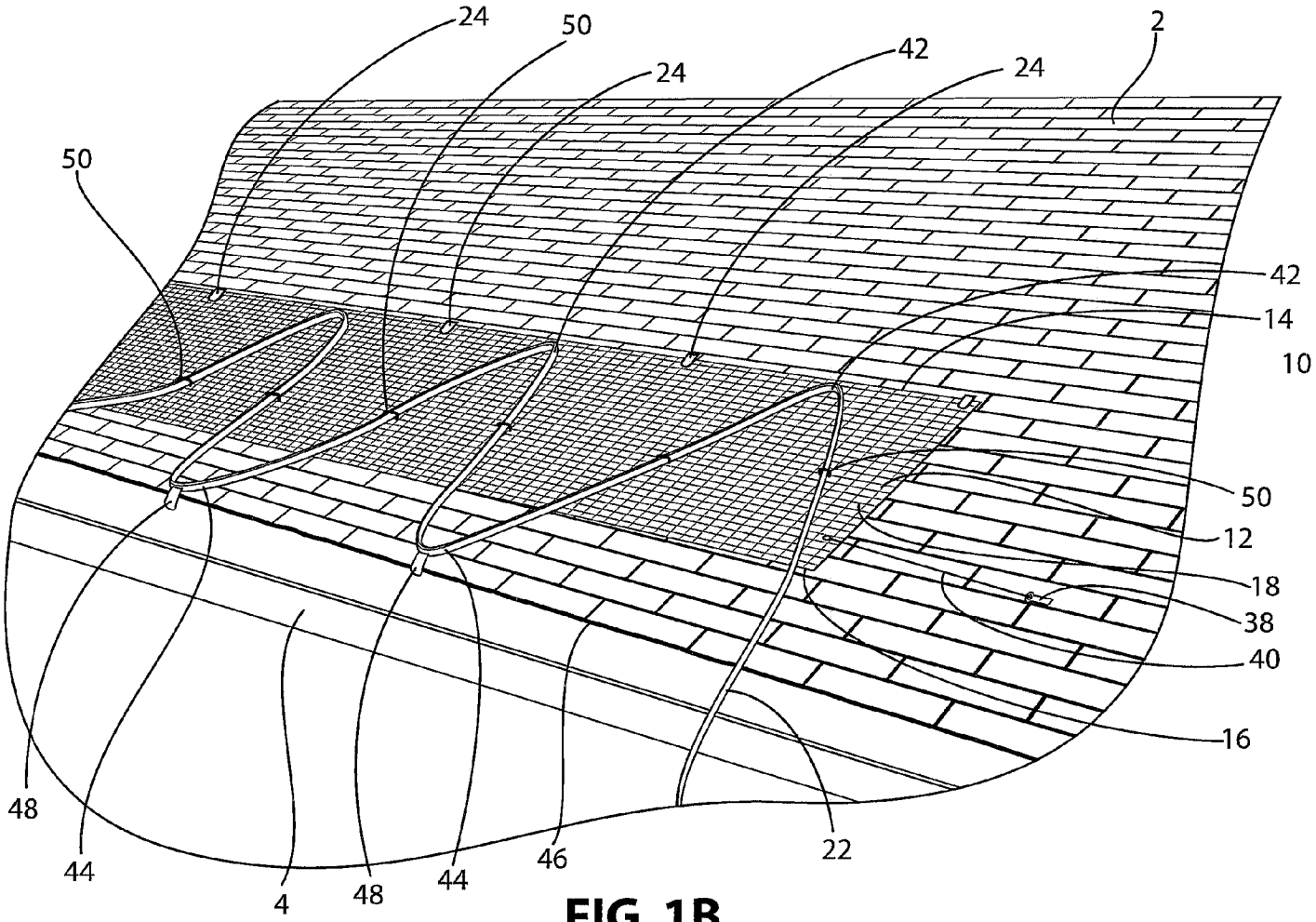
FIG. 1B is a perspective view of the portable heating arrangement of a FIG. 1A in an unrolled position and installed on a surface to be heated, according to the principles of the present invention.

With reference to FIGS. 1A and 1B, the arrangement 10 is depicted, placed on the surface 2. In FIG. 1A, the arrangement 10 is in a rolled position, which allows a user to easily transport the arrangement 10 prior to installation. In FIG. 1B, the arrangement 10 has been unrolled and installed on the surface 2.

Figure 2:
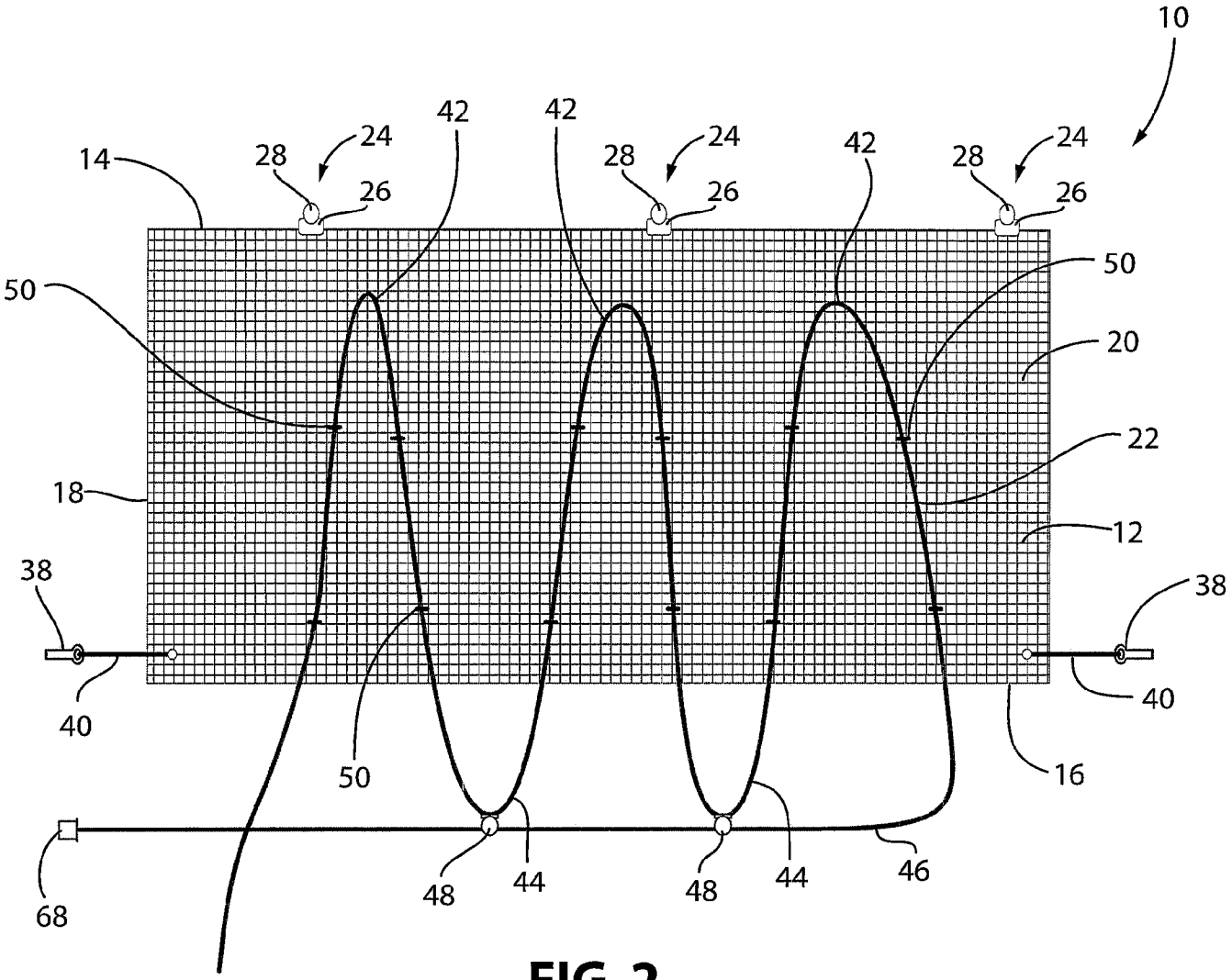
FIG. 2 is a top view of the portable heating arrangement of FIG. 1B, according to the principles of the present invention.

As illustrated in FIG. 2, and according to one preferred and non-limiting embodiment, the arrangement 10 includes a base 12 having an upper edge 14, a lower edge 16, and opposing side edges 18, 20. The base 12 may include a mat at least partially formed from a flexible sheet, which can be easily rolled and unrolled. The flexible sheet may at least partially include a wire material, a mesh material, a polymer mesh material, a weather resistant material, or any combination thereof. In the rolled position, the arrangement 10 is easy to transport and small enough for convenient storage in a basement or closet. Various ties and clips, as described in greater detail below, can be affixed to the base 12 through the mesh openings.

The arrangement 10 further includes a heating conduit 22 directly or indirectly mounted to the base 12. The base 12 and attached heating conduit 22 are configured to rest against the surface 2 of the roof. For example, the base 12 may be placed directly on the surface 2, such that a textured portion of the surface 2 and/or base 12 holds the arrangement 10 in the desired position. Alternatively, the back side of the base 12 may include an adhesive portion for more securely attaching the base 12 to the surface 2. Alternatively, in a preferred and non-limiting embodiment, the base 12 is attached to the surface 2 by connectors 24. The connectors 24 may be anchored to the base 12, through the square openings of the mesh material.

Figure 3:
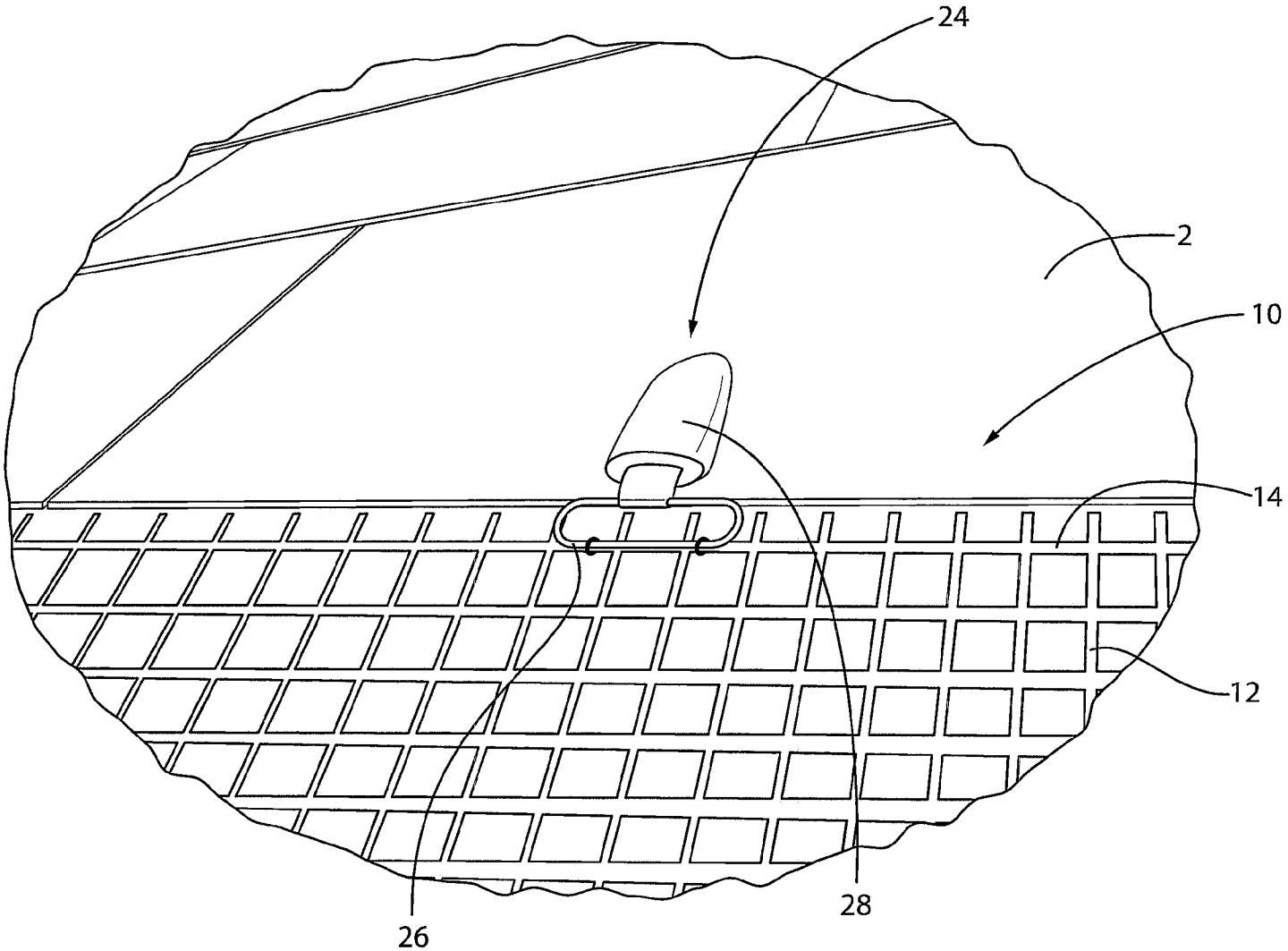
FIG. 3 is an enlarged perspective view of the portable heating arrangement of FIG. 1B, focusing on the connectors for connecting the arrangement to the surface, such as a roof, according to the principles of the present invention.

In one preferred and non-limiting embodiment, the connectors 24 are clips having a body 26, connected to the base 12, and jaws 28 extending from the body 26. A part of the surface 2, such as a roof shingle, is inserted between the jaws 28 and the jaws 28 are clamped together. Pressure exerted between the jaws 28 retains the surface 2 within the connector 24, thereby anchoring the base 12 to the surface 2 without piercing the surface 2. In certain preferred and non-limiting embodiments, adapted for use with a metal roof, the connectors 24 may be one or more magnets that attach to the surface 2 by magnetic attractive forces. An enlarged version of an exemplary connector 24 attached to the surface 2 is depicted in FIG. 3.

Figure 4:
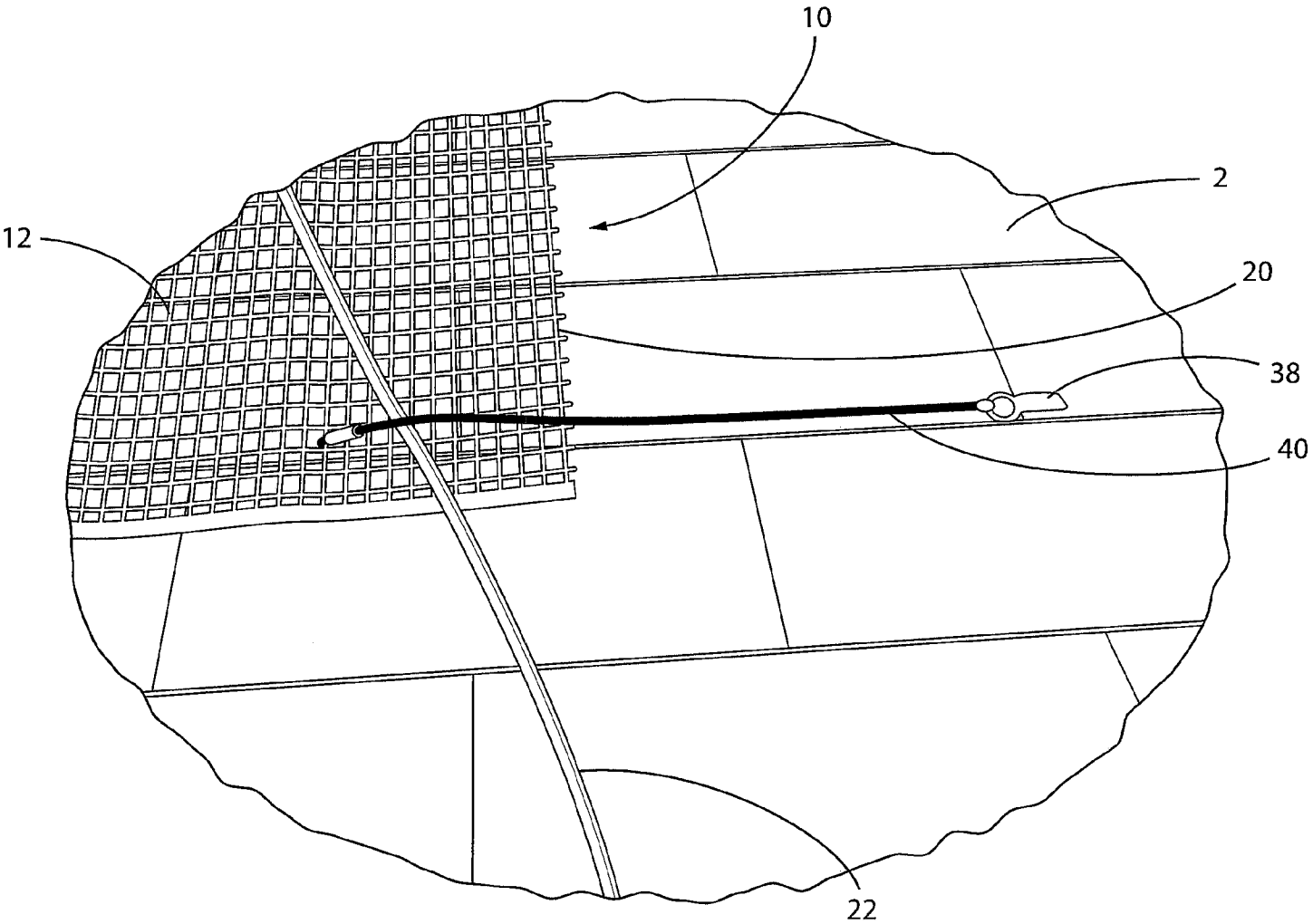
FIG. 4 is an enlarged perspective view of an extendable connector of the portable heating arrangement of FIG. 1B, for connecting the side portion of the arrangement to the surface to be heated, according to the principles of the present invention.

With continued reference to FIG. 2, the arrangement 10 may further include extendable connectors, consisting of a side connector 38, such as the clip described above, connected to the base 12 by a tether 40. The tether 40 extends from the side edge 18, 20 of the base 12 and is used to anchor the side edge 18, 20 to the surface 2. In one preferred and non-limiting embodiment, the tether 40 is an elastically retractable material such as a bungee cord. Advantageously, when the arrangement 10 is in the rolled position, as shown in FIG. 1A, the tether 40 may be attached to the rolled arrangement 10 and used to prevent the rolled arrangement 10 from unrolling. The tether 40 may also be an adjustable strap, such as a nylon cord formed from tubular webbing. The installer may adjust the length of the tether 40 so that the attached connector 24 can be attached to an easily accessible section of the roof surface 2. For example, on a roof having a plurality of rectangular shingles, the installer may adjust the length of the tether 40 so that the side connector 38 can be attached at a vertical joint between adjacent shingles as shown in FIG. 4. While the tether 40 and connector 38 are depicted as being used to affix a side portion of the base 12 to the surface 2, it is understood that the tether 40 and connector 38 may also be used to attach other portions of the base to the surface 2. For example, the tether 40 and connector 38 could be used to secure the upper 14 or lower 16 edges of the arrangement 10 to the surface 2. An enlarged exemplary embodiment of the extendable connector including the tether 40 and connector 38 is depicted in FIG. 4.

With continued reference to FIG. 2, in one preferred and non-limiting embodiment, the heating conduit 22 is arranged in a substantially zig-zag configuration. When viewed from a top view, the zig-zag configuration is an oscillatory wave including upper crest portions 42 and lower crest portions 44. The lower crest portions 44 may extend below the lower edge 16 of the base 12. Since the lower crest portions 44 of the heating conduit 22 extend beyond the base 12, the lower crest portions 44 can be bent into a trough or channel 4. In one preferred and non-limiting embodiment, the distance between the apex of the lower crest 44 and the lower edge 16 of the base 12 is about ⅓ of the total amplitude distance of the oscillatory wave of the zig-zag pattern. It is noted, however, that a heating conduit 22, such as a heat radiating cable for outdoor use, generally does not bend easily. More specifically, such cables lack shape memory and will revert back to the unbent position unless they are held in place. Therefore, a connector, adhesive, or guide may be necessary to ensure that the heating conduit 22 remains within the trough or channel 4. An exemplary embodiment of a guide for maintaining a heating conduit 22 within a trough or channel 4 is described in greater detail below.

In certain preferred and non-limiting embodiments, the heating conduit 22 further comprises a straight portion 46 adapted to be placed along the trough or channel 4 to provide heat thereto. The straight portion 46 may be connected to the lower crest portions 44 of the conduit 22 by a plurality of conduit connectors 48. Both the lower crest portions 44 and straight portion 46 of the heating conduit 46 may be bent and retained within the trough or channel 4.

In a further preferred and non-limiting embodiment, the heating conduit 22 includes one or more female plugs 68 connected or arranged at one end of the heating conduit 22. If the installer intends to cover a larger area of a roof or gutter, a second heating arrangement 10 may be connected to the heating conduit 22 of the first arrangement 10 through the female plug 68. In that way, electric current providing power to the first arrangement 10 can be transferred to the second arrangement 10 without requiring an additional power supply. Alternatively, additional electrical devices or items such as Christmas lights could be connected to a power supply through the female plug 68 of the heating conduit 22.

Optionally, the heating conduit 22 is mounted to the base 12 with a plurality of cable ties 50. The cable ties 50 may be releasable, allowing the installer to release the conduit 22 from the base 12 and rearrange it for use with different types of roofs and gutters. For example, the installer could increase the overhang distance that the conduit 22 extends beyond the lower edge 16 of the base 12, so that the conduit 22 can be pushed farther into the trough or channel 4. Alternatively, the installer may increase the longitudinal distance between crest portions so that the conduit 22 extends a greater distance along the surface 2. Once the heating conduit 22 is rearranged to the new position, the ties 50 can be reattached. Such variability in the placement of the heating conduit means that the arrangement 10 can be easily modified to work with different roof pitches and gutter styles.

In a preferred and non-limiting embodiment, the tie 50 may be a standard cable tie, as is known in the art. A standard cable tie 50 includes a ring or loop formed from a thin band inserted through a locking aperture. The conduit 22 is inserted in the loop and fastened into place by pulling the thin band through the aperture to cinch the tie 50 against the conduit 22. The locking aperture would also include a release button. Pressing the release button allows the band to slide through the aperture in the opposite direct to release the tie 50 from the base 12. Once the tie 50 is released, a user can reposition the conduit 22 on the base 12 and reconnect the tie 50 to hold the conduit in the new position.

Figure 5:
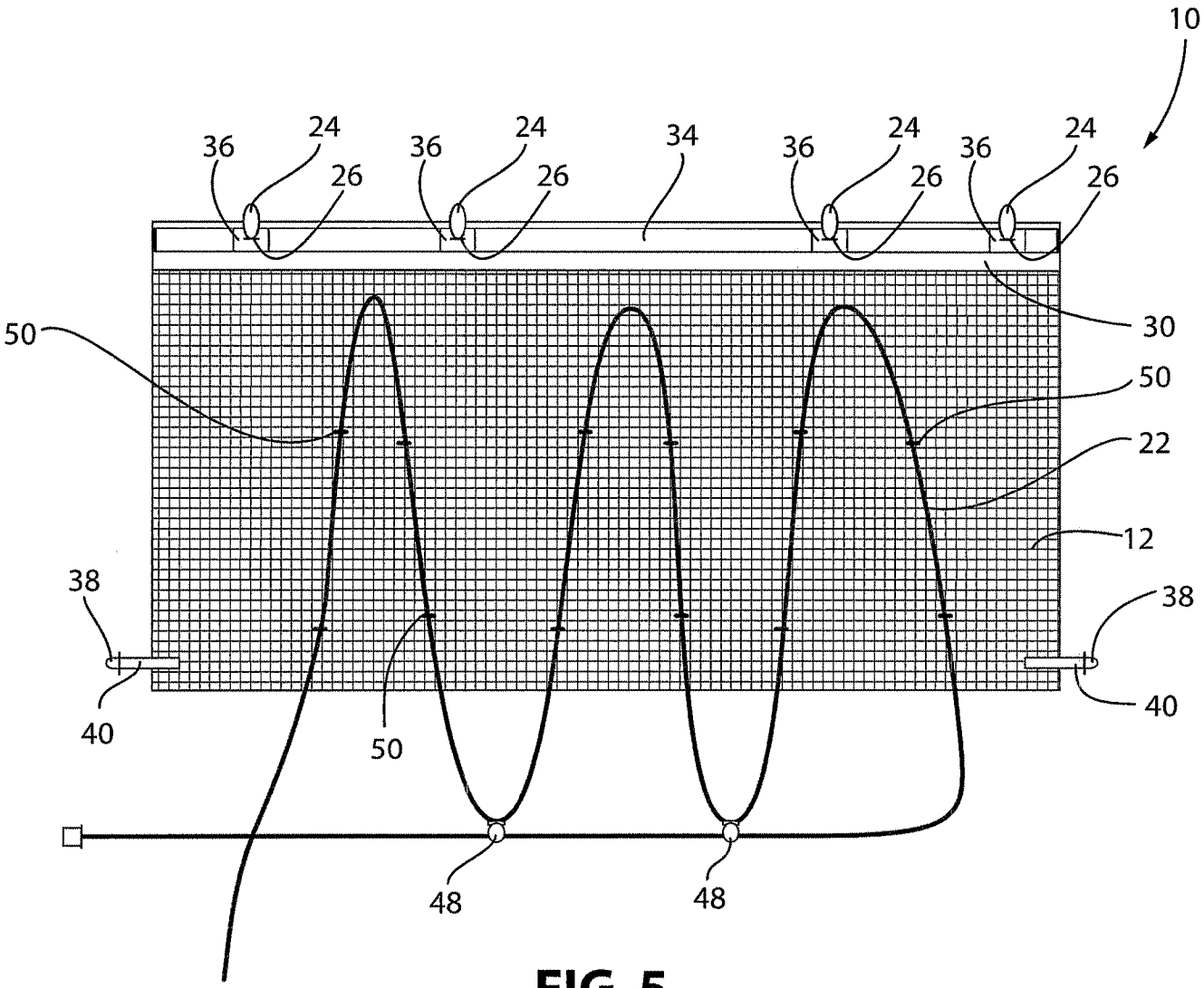
FIG. 5 is a top view of a portable heating arrangement, according to the principles of the present invention.
Figure 6:
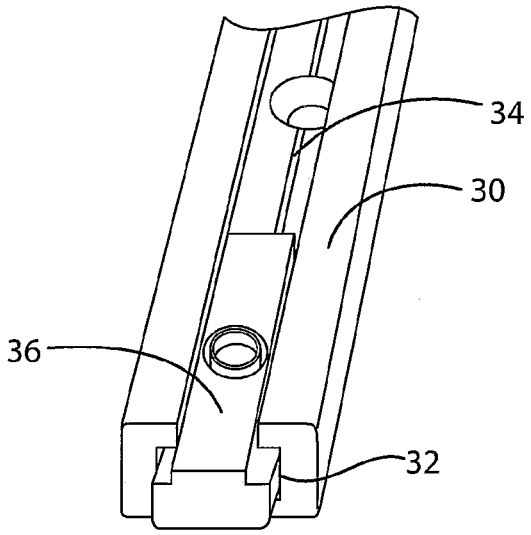
FIG. 6 is a perspective view of the track of the portable heating arrangement of FIG. 5, according to the principles of the present invention.
Figure 7:
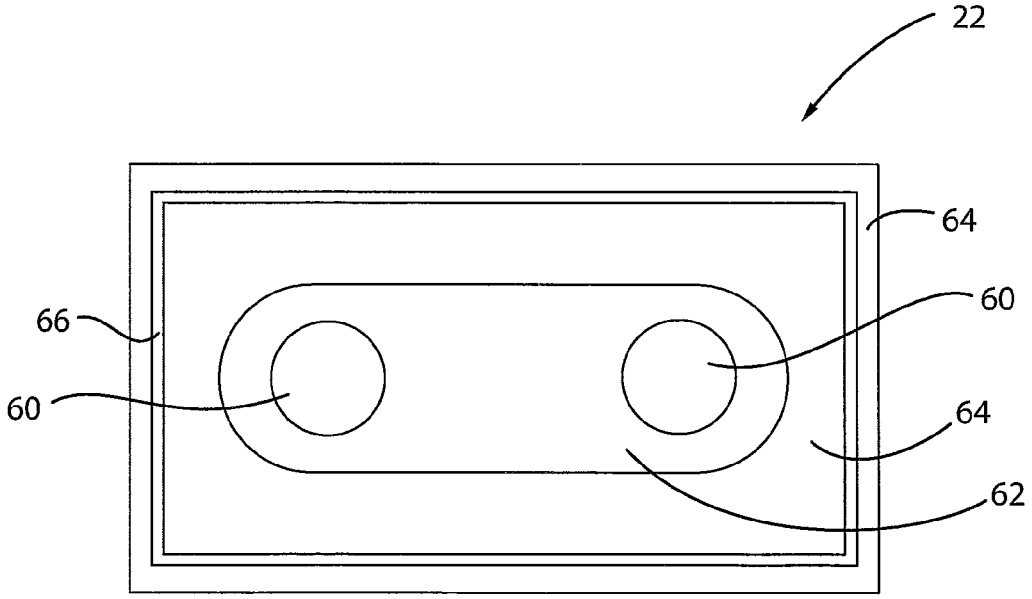
FIG. 7 is a cross section view of a heating cable of the portable heating arrangement of FIG. 1B, according to the principles of the present invention.

With reference to FIG. 5, in a further preferred and non-limiting embodiment, the base 12 of the heating arrangement 10 includes a track 30 extending along a portion (such as the periphery) of the base 12. Connectors 24 are slidably mounted within the track 30. The installer slides the connectors 24 along the track 30 to a desired location along the periphery of the base 12. In this way, the installer positions the connectors 24 at locations where they can be most easily connected to the roof surface 2. More specifically, and with reference to FIG. 6, in one preferred and non-limiting embodiment, the track 30 is a flexible T-track consisting of a flexible member having an open cavity 32 accessible through a longitudinal slot 34. Track inserts 36, attached to the connectors 24, are slidably inserted in the cavity 32. The connectors 24 extend through the slot 34. The track 30 may be permanently or removably connected to the surface 2, and the track inserts 36 may be attached to or integral with one or more connectors 24.

In any of the above described embodiments of the arrangement 10, the heating conduit 22 may be a metal wire with high resistance enclosed by a polymer or rubber jacket. When electric current passes through the high resistance wire, heat is produced. Alternatively, with particular reference to FIG. 7, in one preferred and non-limiting embodiment, the heating conduit 22 is a self-regulating cable, as is known in the art. The self-regulating cable includes two or more metal bus wires 60 extending longitudinally along the length of the conduit 22. The bus wires 60 are surrounded by a core 62 formed of a conductive polymer that produces heat when exposed to electric current. The conductive core 62 may by a fire resistant material to prevent the conduit 22 from catching fire when heated for extended periods of time. The conductive core 62 is enclosed by one or more rubber or synthetic polymer sheaths 64. The one or more sheaths 64 provide structural stability for the conductive core 62 and bus wires 60. The sheaths 64 may also increase the lifespan of the conduit 22 by, for example, preventing water or UV radiation from damaging the core 62 and/or wire 60. A structural layer 66, such as a copper braid layer, may provide additional structural stability for the conduit 22.

Figure 8:
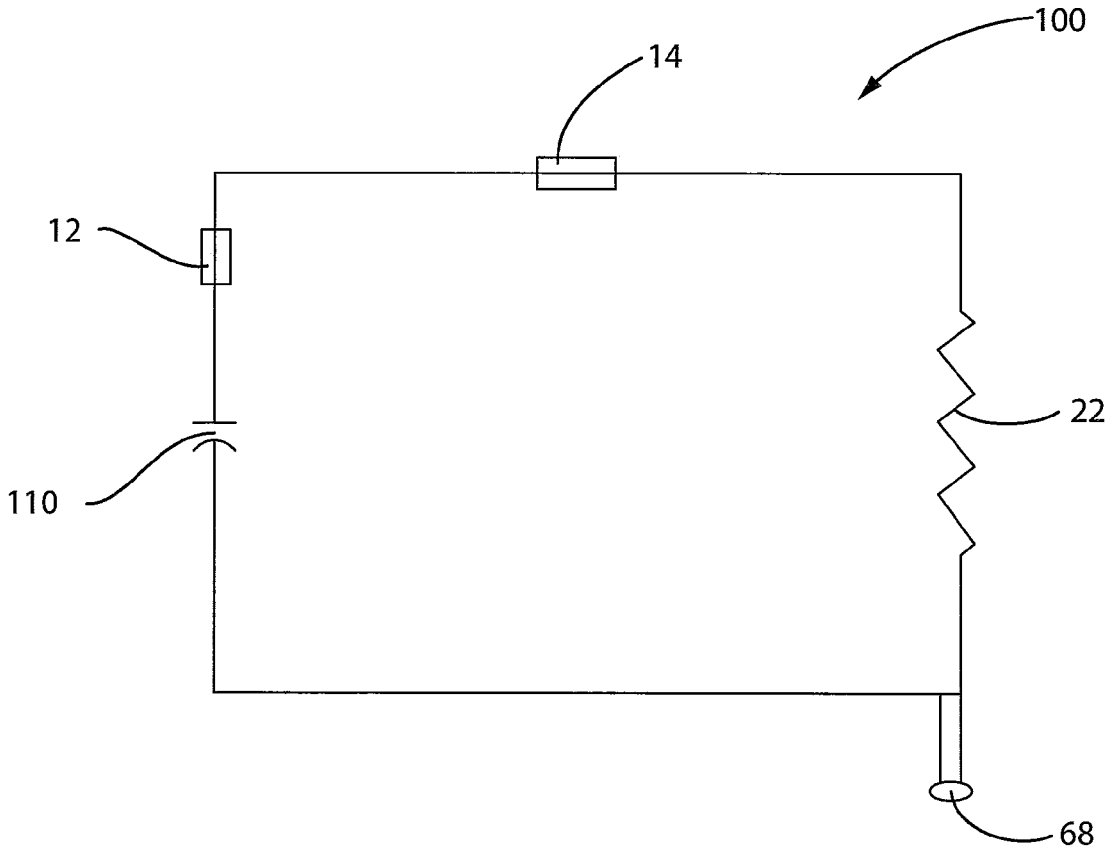
FIG. 8 is a schematic drawing of a circuit of the portable heating arrangement of FIG. 1B, according to the principles of the present invention.

With reference to FIG. 8, and in one preferred and non-limiting embodiment, the heating conduit 22 is part of a larger electrical circuit 100 including a power supply 110 in electrical connection with the heating conduit 22. The power supply may be a standard electrical outlet providing 120 volts of alternating current. In that case, the heating conduit 22 is connected to the electrical outlet with a standard plug. Alternatively, the power supply 110 may be a battery providing direct current or an alternative electricity supplying device, such as a generator or solar panel. The circuit 100 may further include switches 112 for turning the heating arrangement 10 "on" and "off". If the heating conduit 22 includes self-regulating cables, a temperature sensor 114 which automatically adjusts the power provided to the heating conduit 22 may also be included within the circuit 100. As described above, as the temperature drops, the wattage increases, thereby increasing the heat provided by the cable. In addition, it is envisioned that the further switches 112 or controls may be provided to adjust the supplied power, to adjust the temperature, to control one or more differentiated female plugs, to control timing functions, and the like. For example, the user may wish to turn other devices (such as Christmas lights) "on" or "off" or on a timing sequence separate and apart from the arrangement 10.

Figure 9:
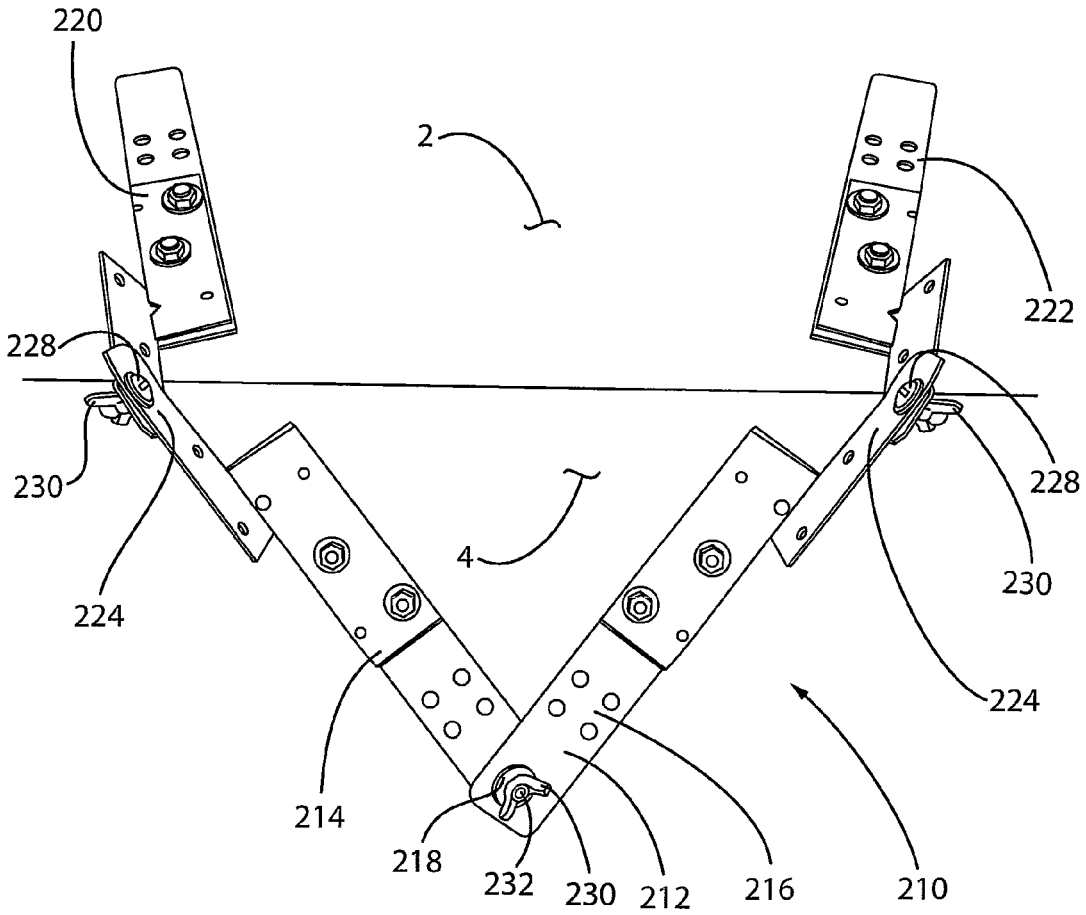
FIG. 9 is a perspective view of a guide for use with the portable heating arrangement of FIG. 1B, according to the principles of the present invention.
Figure 10:
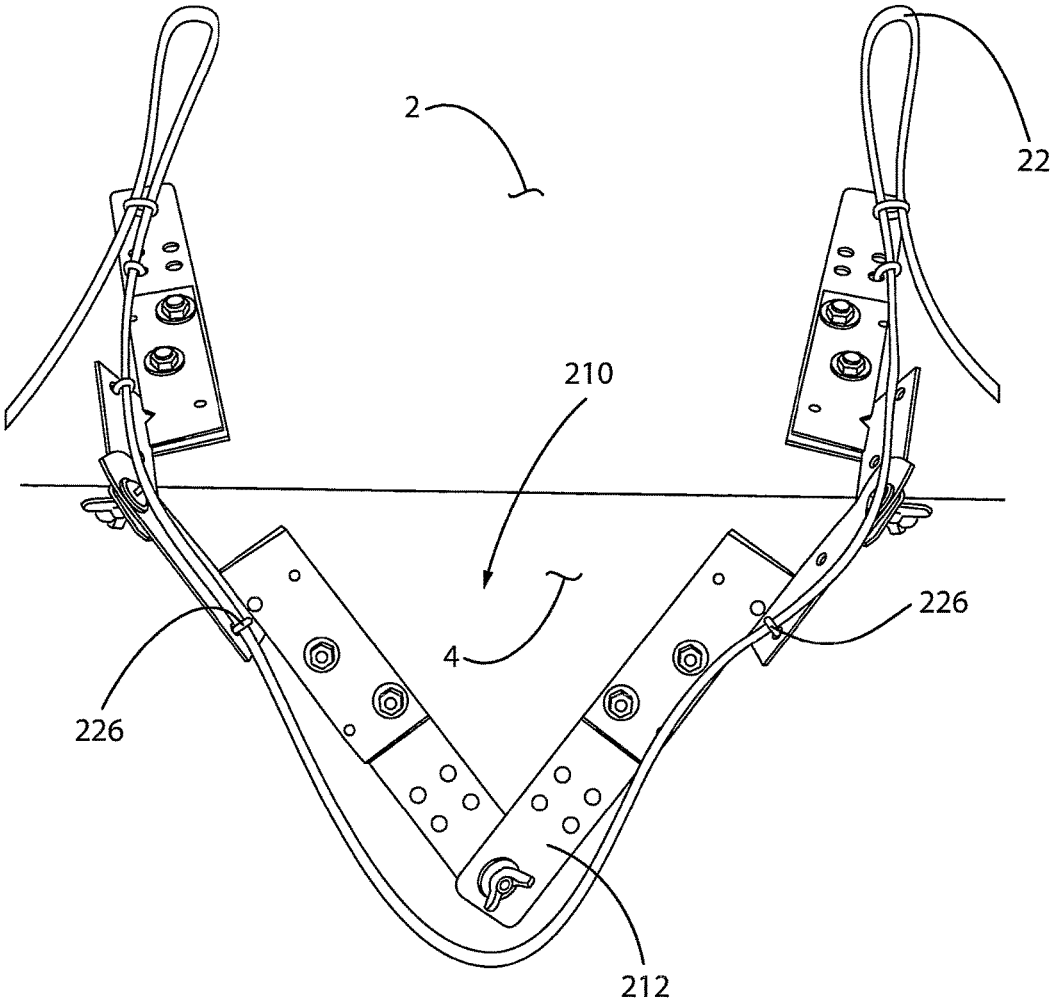
FIG. 10 is a perspective view of the guide of FIG. 9 with a heating conduit attached thereto, according to the principles of the present invention.
Figure 11:
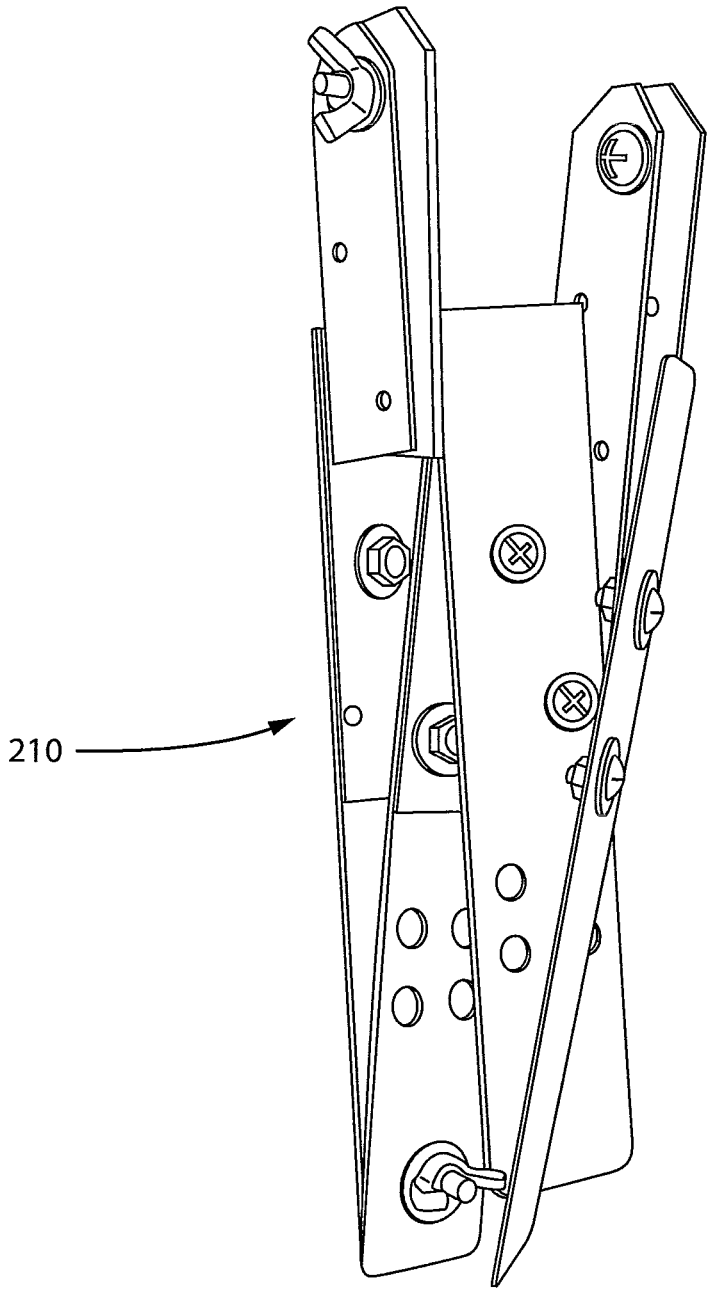
FIG. 11 is a perspective view of the guide of FIG. 9 in a folded position, according to the principles of the present invention.

In a further preferred and non-limiting embodiment, the arrangement 10 includes a guide 210 for maintaining a portion of the heating conduit 22 within the trough or channel 4. With reference to FIGS. 9-11, the guide 210 includes an adjustable V-shaped body 212 having a first member 214 and a second member 216 joined at a center 218. A first arm 220 extends from the end of the first member 216 opposite the center 218. A second arm 222 extends from the end of the second member 216 opposite the center 218. The arms 214, 216 and members 220, 220 are connected together through rotation joints 224. The guide 210 further includes a plurality of ties 226 (or other connectors) for permanently or removably affixing the heating conduit 22 to the guide 210. The guide 210 is adapted to be placed at the edge of a roof surface 2 near the trough or channel 4 (e.g., a gutter). The guide 210 is bent into the trough or channel 4 by rotating the rotation joints 224 in the downward direction. In this configuration, the first arm 220 and second arm 222 abut the roof surface, providing stability for the guide 210. The body 212 and attached heating conduit 22 are bent downward into the trough or channel 4. The guide 210 may be used in conjunction with the portable heating arrangement 10 of the present invention, and further, may be permanently or removably attached thereto. Specifically, in one preferred and non-limiting embodiment, the V-shaped body 212 of the guide is attached to a lower crest 44 of the heating conduit 22 using the ties 226. The guide 210 may also be used with cables for permanent roof and gutter de-icing systems, as are known in the prior art.

In certain embodiments, the guide 210 is formed from one or more pieces of a conductive material such as aluminum. The conductive material distributes heat from the heating conduit 22, thereby increasing the area of the gutter exposed to heat and reducing the likelihood that ice will form within the gutter, even as the air temperature drops. In one embodiment, each section (i.e., the first member 214, second member 216, first arm 220, second arm 222) is stamped from a single piece of aluminum. The sections are connected together at the rotatable joints 224 by a fastener 228, such as a screw or pin. Once the guide 210 is adjusted to best fit the shape of the roof and gutter, the joint 224 is locked in place to prevent further rotation. For example, for joints having a screw type fastener 228, a wing-nut 230 or similar tightening device may be clamped down on the fasteners 228 to prevent further rotation of the joints 224.

In certain preferred and non-limiting embodiments, the guides 210 are not connected to the roof or gutter, but merely rest against the roof surface 2. Accordingly, to remove the guide 210 from the surface 2, an installer needs only to disconnect the heating conduit 22 from the guide 210. As shown in FIG. 11, the joints 224 can then be loosened and the guide 210 folded up for easier transport and storage. In certain configurations, the center 218 of the V-shaped body 212 is an adjustable pivot point 232. As with the joints 224, the center joint 232 can include a fastener 228 and wing-nut 230 for tightening and loosening the center joint 232. In this way, the angle of the body 212 can be adjusted to accommodate various sizes of heating conduits 22. The installer can bend the guide so that the guide 210 is best able to hold the heating conduit 22 within the gutter.

Having described various preferred and non-limiting embodiments of the portable heating arrangement 10 in detail, the steps for installing and using the arrangement 10 and guide 210 according to one preferred and non-limiting embodiment will now be described. In use, an installer places the arrangement 10 on the roof surface 2 near the edge of the surface 2 adjacent to the trough or channel 4. Initially, the arrangement 10 will be rolled up to make it easier to carry. The installer unrolls the arrangement 10 placing the base 12 flat against the roof surface 2. Generally, the heating conduit 22 will be attached to the base 12 in the desired configuration before the arrangement 10 is placed on the roof surface 2. However, if certain adjustments are needed, the installer can release the ties 50 that mount the heating conduit 22 to the base 12 and rearrange portions of the heating conduit 22 as necessary to best suit the specific shape of the roof surface 2 and trough or channel 4. The arrangement 10 should be positioned such that the lower crest portions 44 of the heating conduit 22 extend over the edge of the roof surface 2 and toward the trough or channel 4. Optionally, the installer may connect sections of the arrangement 10 to the roof surface 2 using connectors 24, such as clips, before the remaining sections of the arrangement 10 are fully unrolled. In the case of a roof having wood or synthetic shingles, the installer will place a portion of the shingle between the jaws 28 of the clip, to hold the shingle without piercing the shingle. For roofs formed from different materials, such as a metal roof, different connectors can be used.

Once the entire arrangement 10 is unrolled and the upper edge 14 is connected to the roof surface 2, the installer fastens the side connectors 38 to the roof surface 2. The side connectors 28 include the adjustable tether 40 extending over the side edge 18, 20 of the base 12. By adjusting the length of the tether 40, the installer can position the connector 24 in the best location for attachment to a roof shingle. Furthermore, the installer can tighten the tether 40 to reduce the possibility that the base 12 will slip or sag. Once the base 12 is mounted to the roof surface using the connectors 24, the installer attaches the straight portion 46 of the heated conduit 22 to the lower crest portions 44 of the conduit 22 using the conduit connectors 48 extending from the lower crest portions 44 of the conduit 22.

After securing the arrangement 10 to the roof surface 2 with the connectors 24, the installer inserts the heating conduit 22 within the trough or channel 4. The installer may simply bend the heating conduit 22 into the gutter or affix the heating conduit within the gutter using an adhesive, clip, or fastener. Alternatively, the installer may position the guides 210 of the present invention along the edge of the roof. Once the guides 210 are in position, the installer affixes the heating conduit 22 to the guides 210 using ties 226 or similar mounting connectors. The installer then adjusts the guides 210 by rotating the center pivot joint 232 and rotatable joints 224 between the body 212 and arms 220, 222 to bend the heating conduit 22 into the gutter. Once the joints 224, 232 are in the desired position, the installer tightens the wing-nut 230, or otherwise locks the joints 224 in place to prevent further rotation. The installer then hooks the heating conduit 22 to a power source 110. For example, in certain embodiments, the installer simply plugs a male connector located at one end of the heating conduit 22 into a standard electrical outlet. The installer may also attach the portable heat providing arrangement 10 to additional electrical devices, such as switches 112, timers, or temperature sensors 114 to control when the arrangement 10 turns "on" and "off".

In certain preferred and non-limiting embodiments of the invention that include a female plug 68 at one end of the heating conduit 22, an installer may connect heating conduits 22 from several portable heat providing arrangements 10 together to form a long chain. Alternatively, the installer may attach additional electrical devices to the female plug 68, such as decorative features, satellite dishes, or any other electrical device commonly installed on the roof of a building. It is further envisioned that the base 12 may be provided in different shapes and sizes to accommodate different roof or surface configurations. For example, one base 12 may be connected to another base 12, such as through connectable plugs or direct connection of the conduits 22 of each base 12. In addition, connectors may be provided to releasably attach two or more bases 12 together.

At the end of the winter season, the installer (i.e. the property owner) removes the portable heat providing arrangement 10 from the roof surface 2. To remove the arrangement 10, the installer need only unplug the arrangement 10 from the power source 110, release the connectors 24 securing the base 12 to the roof surface 2, and roll the arrangement 10 for easy carrying. The portable heat providing arrangement 10 can then be stored in a dry, dark location to prevent water damage and to prevent weakening of the heating conduits 22 from prolonged exposure to UV radiation. The arrangement 10 is re-installed the following winter.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A portable heating arrangement for providing heat to a surface comprising:

a base configured to rest upon the surface;

at least one heating conduit directly or indirectly mounted to at least a portion of the base and configured to provide heat to the surface; and at least one guide for directing portions of the at least one heating conduit in a downward orientation relative to the base, thereby positioning portions of the heating conduit in at least one of the following: a trough attached to the surface, a channel attached to the surface, a gutter attached to the surface, or any combination thereof, wherein the at least one guide comprises:

a body including a first member and a second member joined at a center, an end of the first member located opposite the center, and an end of the second member located opposite the center;

a first arm extending from the end of the first member at a first rotatable joint;

a second arm extending from the end of the second member at a second rotatable joint; and at least one protrusion extending from the body configured to hold at least a portion of the heating conduit against the body, wherein the first and second rotatable joints rotate the body thereby bending the portion of the at least one heating conduit attached thereto.

2. The portable heating arrangement of claim 1, wherein the guide is capable of being transitioned from a use position to a folded position by loosening one or more of the rotatable joints, wherein a volume of the guide in the folded position is reduced relative to the volume of the guide in the use position.

3. The portable heating arrangement of claim 1, wherein the center comprises an adjustable pivot for modifying an angle between the first member and the second member of the body.

4. The portable heating arrangement of claim 1, wherein the guide is formed from a conductive material for transferring heat from the at least one heating conduit to at least a portion of at least one of the following: a trough attached to the surface, a channel attached to the surface, a gutter attached to the surface, or any combination thereof.

5. The portable heating arrangement of claim 1, wherein the base comprises a flexible sheet capable of being rolled and unrolled.

6. The portable heating arrangement of claim 5, wherein the flexible sheet at least partially comprises at least one of the following: a wire material, a mesh material, a polymer mesh material, a weather resistant material, or any combination thereof.

7. The portable heating arrangement of claim 1, further comprising at least one connector configured to directly or indirectly attach at least a portion of the base to the surface, wherein the connectors comprise clips configured to engage the surface by a frictional engagement and without piercing the surface.

8. The portable heating arrangement of claim 1, wherein the at least one heating conduit is releasably mounted to the base by at least one tie, such that the at least one tie can be disconnected from the base, the at least one heating conduit moved to a different location on the base, and reconnected to the base with the at least one tie, thereby modifying a pattern of the at least one heating conduit.

9. The portable heating arrangement of claim 1, wherein the at least one heating conduit comprises a power supply directly or indirectly coupled to at least one heating cable, and wherein the at least one heating cable includes at least one conductive core encased within a protective sheath.

10. The portable heating arrangement of claim 9, wherein the at least one heating cable comprises a female plug so that another electrical device may be connected to the power supply through the at least one heating cable.

* * * * *